US006170215B1

(12) United States Patent
Nasi

(10) Patent No.: US 6,170,215 B1
(45) Date of Patent: Jan. 9, 2001

(54) SIDING PANEL WITH INTERLOCK

(76) Inventor: Evert Edward Nasi, E5936 Bluffview Rd., Ironwood, MI (US) 49938

( * ) Notice: Under 35 U.S.C. 154(b), the term of this patent shall be extended for 0 days.

(21) Appl. No.: 09/393,829

(22) Filed: Sep. 10, 1999

(51) Int. Cl.[7] ..... E04D 1/00
(52) U.S. Cl. ..... 52/521; 52/552
(58) Field of Search ..... 52/518, 519, 520, 52/521, 522, 525, 539, 543, 552

(56) References Cited

U.S. PATENT DOCUMENTS

| | | | | |
|---|---|---|---|---|
| Re. 17,143 | | 11/1928 | Fischer . | |
| 359,958 | * | 3/1887 | Cortright et al. | 52/522 |
| 2,201,175 | | 5/1940 | Harshberger . | |
| 2,266,746 | | 12/1941 | Elmendorf . | |
| 2,361,831 | * | 10/1944 | Ellis | 52/521 |
| 2,735,143 | * | 2/1956 | Kearns | 52/521 |
| 3,217,453 | | 11/1965 | Medow | 52/314 |
| 3,228,164 | | 1/1966 | Ettore | 52/539 |
| 3,327,446 | * | 6/1967 | Tracy | 52/552 X |
| 3,505,770 | | 4/1970 | Bennett | 52/309.13 |
| 3,511,008 | * | 5/1970 | Grems et al. | 52/552 X |
| 4,015,391 | | 4/1977 | Epstein et al. | 52/520 |
| 4,031,683 | | 6/1977 | Walker | 52/536 |
| 5,775,042 | | 7/1998 | Mowery et al. | 52/520 |

FOREIGN PATENT DOCUMENTS

| | | | | |
|---|---|---|---|---|
| 89120 | * | 2/1957 | (NO) | 52/543 |

OTHER PUBLICATIONS

Center Lock Brochure, double locked for twice the beauty, quality and satisfaction, 2 sheets, Aug. 1999.

* cited by examiner

*Primary Examiner*—James O. Hansen
(74) *Attorney, Agent, or Firm*—Jerry F. Janssen; Thomas D. Wilhelm

(57) ABSTRACT

A retaining clip for use in combination with building siding panels of the type which simulate wooden clapboard. The siding panels have two or more longitudinal outwardly and downwardly depending declination portions. The clips comprise thicker main body portions attachable to the building-side face of declinations of the siding panels, and thinner flexible arm portions. A protruding stop detent extends from the face of the flexible arm portion. The detent is spaced apart from the main body portion of the retaining clip. Building siding panels having retaining clips of the invention are also provided, as are methods of siding a building with the modified siding panels. The modified siding panel assemblies preferably have retaining clips attached to at least one end of each declination portion of the siding panels in an orientation which permits insertion of the declination portion of a horizontally adjacent panel between the flexible arm portion of the retaining clip and the building side of the declination portion of the panel to which the clip is attached. A detent can be used on the face of the retaining clip to resist horizontal movement of the inserted panel as the panel is inserted, but such detent does not prohibit horizontal movement of the inserted panel, thus providing for thermal expansion of the mounted siding panels.

22 Claims, 9 Drawing Sheets

SIDING PANEL WITH INTERLOCK

BACKGROUND OF THE INVENTION

Panels of a variety of structural designs for use in siding or covering the exterior walls of buildings have been known for a long time. These siding elements are generally constructed of a metal, typically aluminum, or a thermoplastic material. In the latter case, poly(vinyl chloride) or "PVC" is typically employed because of its superior resistance to weathering.

In order to simulate the clapboard wooden siding commonly used in home construction, metal or thermoplastic siding elements are typically constructed with so-called "declinations" or downwardly and outwardly extending flat portions which are connected by horizontal shoulders. Additionally, structural features are provided on the siding elements including an uppermost nailing strip and elements which permit interlocking panels above or below one another. These siding panels are typically supplied commercially in so-called "two-wide" and "three-wide" versions. In two-wide panels, there are two declinations: an upper declination and a lower declination, connected by a short horizontal shoulder. Three-wide siding panels have three such declinations, with horizontal shoulder regions connecting the upper to the middle declination and another horizontal shoulder connecting the middle declination to the lowest declination.

The rear or building-facing view of one such siding panel 100, which finds current wide use in the building trades, is illustrated in FIG. 1 in rear perspective view. The panels are commercially provided in long sections, typically in lengths of 12 feet (3.66 meters) to 16 feet (4.88 meters). In FIG. 1, the center portion of the illustrated panel has been removed to show only the first 102 and second 104 end regions of the panel.

The panel 100 comprises a first upper 106 and a second lower 108 substantially flat declination region. The upper declination 106 is connected to the lower declination 108 by substantially horizontal shoulder region 110. A similar shoulder region 112 is attached to lower declination 108. The shoulder 112 attached to the lower declination 108 is further provided with a re-curved edge region 114 which extends upwardly and slightly inwardly toward the back or inside face of lower declination 108. This re-curved edge of lower shoulder 114 is designed to fit into a substantially S-shaped recurve on the next lower panel in a manner shown in FIG. 4 and further described below.

The upper declination 106 of the siding panel 100 is surmounted by an integral nailing strip and clamping region. The nailing strip and clamping region of the siding panel is made up of an upper flat nailing strip 116 which is perforated by nailing holes 120. As the flat nailing strip merges with the upper declination 106, the panel forms a clamping region 118 which forms, in side view, a substantially S-shaped recurve 122. The lower end of this S-shaped clip region 118 merges with the upper declination 106. The nailing strip 116 and S-shaped recurve portion of the first 102 and second 104 ends of panel 100 are trimmed at the factory to form first 124 and second 126 cut-outs, respectively, in the upper nailing strip 116 and S-shaped recurve 122. Similar cut-outs 128 and 130 are made in the lower shoulder region 112 and its recurve portion 114.

When siding panels of this type are applied to a building, a special initial nailing strip or "starter strip" shown in FIG. 2 is first attached at the bottom of the wall being sided. This starter strip 200 comprises the nailing strip portion 216, an S-recurve portion 222, and nail holes 220 of a siding panel, but lacks the declination portions.

FIG. 3 depicts, in cross-sectional side view, how a first siding panel of the type shown in FIG. 1 is attached to a building wall. Following attachment of the starter strip 200, of FIG. 2, to the building wall 310 by means of nails 306, the recurve 114 of the lower shoulder 112 of a first siding panel is inserted into the S-shaped recurve 222 of the starter strip. The panel is pulled firmly upward, and nailed (through nailing holes 120 in its top nailing strip 116, not shown in FIG. 3) to the building wall 310. Subsequent siding panels are similarly attached to the wall of the building, proceeding upwardly, clipping the lower shoulder recurve 114 of each successive panel into the upper S-shaped clamping region 118 of the siding panel immediately below.

This arrangement can be seen in FIG. 4 where a cross-sectional side view of two vertically adjacent siding panels are shown fastened to the wall of a building. In FIG. 4, the lower declination 108*a* of an upper siding panel and the upper declination 106 of a lower siding panel, both of the type shown in FIG. 1, are shown fastened to a building wall 310. The lower shoulder region 112*a* of the upper panel, with its recurve 114*a*, is shown clipped into the S-recurve 122 of the lower panel. Both the nails holding the starter strip and the nails securing the siding panels to the building wall are not completely driven into the building wall 310 through the elongated nail holes. This permits lateral thermal expansion and contraction of the siding panels after being mounted to the building wall.

As the siding is laid up, the lateral joints between adjacent sets of attached siding panels are staggered, rather than being vertically aligned, to provide a pleasing appearance. Typically, the nailing strips and bottom declination shoulders of commercially available siding panels are notched during manufacture to assist in the side-by-side interlocking of adjacent panels. These cut-outs can be seen as elements 124, 126, 128 and 130 in FIG. 1. By clipping the notched lower shoulder of one panel and its recurve of each siding panel into the S-recurve clamp of the panel (or starter strip) immediately adjacent below, horizontally adjacent siding panels can be overlapped making use of these cut-outs. This arrangement can be seen in FIG. 5 where two siding panels, 102 and 102*a* of the type depicted in FIG. 1 are shown overlapping.

In FIG. 5, for purposes of illustration, the two panels are shown as abbreviated in length. Panel 102*a* is shown overlapped behind panel 102. The terms "front" and "rear" or "in front of" or "behind," "up" and "down," "inwardly" and "outwardly" with regard to the siding panels or elements thereof, as used throughout this specification and the appended claims refer, respectively, to the faces and orientation of the panels and panel elements once the panels are applied to a building.

In the following discussion, reference numerals without prime marks are used in referring to elements of panel 102 and the same reference numerals with prime marks are used for corresponding elements of panel 102*a*. As can be seen in FIG. 5, the overlap is achieved by inserting the cut-out 128' in the lower left-hand rear face of panel 102*a* into the cut-out 130 in the lower right-hand rear face of panel 102. In a similar manner, the cut-out 126 in the nailing strip and S-recurve at the upper right-hand face of panel 102 is inserted into the cut-out 124' in the upper left-hand rear face of panel 102*a*. As a result of this overlap, a portion of cut-out 126 in panel 102 is clipped into the S-recurve at the top of panel 102*a*. During installation of the siding, the two panels are overlapped, retaining a gap 550 in the cut-outs between horizontally adjacent panels to permit thermal expansion and contraction of the panels. The overlap is indicated by the dotted line in FIG. 5 which represents the hidden rearward right-hand edge 560 of panel 102.

This prior art combination of lateral overlapping of horizontally adjacent siding panels, and vertical interlocking and nailing (in the manner described above) results in the firm attachment of each siding panel to a building wall at the upper and lower extremities of each panel. However, this arrangement does not provide for adequate interlocking of the intermediate declinations of one siding panel to those of a panel next horizontally adjacent. The problem exists with two-wide siding panels, and is considerably exacerbated with three-wide and wider siding panels. There are four undesirable effects of this lack of interlocking: first, gaps in the declinations of one siding panel and those immediately horizontally adjacent are unsightly. Second, wind can catch and pull off a siding panel if gaps exist between the declination of one panel and those of its neighbor. Third, a loose fit between the declinations of one panel and those of a horizontally adjacent panel permit rain to enter and cause water damage and rot to the underlying wooden structure. Finally, insect infestation behind the mounted siding can cause bulging in the siding if gaps in the declination overlap permit insect entry. There is thus a strong need in the building trades for an improved type of vinyl siding which overcomes these problems.

SUMMARY OF THE INVENTION

These, and other problems are solved by the present invention which provides, in its broadest aspect, a retaining clip for use in combination with building siding panels of the type which simulates wooden clapboard. The panels have a first end and a second end, and two or more longitudinal outwardly and downwardly depending declination portions. The uppermost declination portion of the panels are surmounted by a longitudinal clamping region having a substantially S-shaped recurved cross-section and a longitudinal nailing strip. The lowermost declination portion of the panels terminates at its lower extremity with an upwardly curving longitudinal edge which is receivable in the S-shaped recurved clamping region of a vertically adjacent siding panel when the panels are mounted to a building wall.

The retaining clips of the principal embodiment of the invention comprise a body having first and second ends, first and second sides, an upper face and a lower face. The lower face of the clip is divided into two portions, the first lower face portion being offset from the second lower face portion in a direction away from the upper face to define a ledge which divides the retaining clip into a thicker main body portion and a thinner flexible arm portion depending therefrom. The lower face of the flexible arm portion is provided with a protruding stop detent spaced apart from the ledge of the retaining clip.

In an alternative embodiment, the end of the retaining clip distal from the main body portion of the clip is curved so that when the clip is attached to a rear-face of a declination portion of a siding panel, the end of the clip curves away from the rear face of the declination portion of the panel to which the clip is attached, providing a facile starting point for the insertion of an adjacent siding panel in use.

In accordance with a second embodiment of the invention, there are provided building siding panels having a retaining means for lateral or side-by-side clamping of a declination portion of one siding panel to the corresponding declination portion of a laterally adjacent siding panel. The siding panels are of a type which simulates wooden clapboard and have one or more retaining clips of the present invention attached. The panels have two or more longitudinal outwardly and downwardly depending declination portions. The uppermost declination portion of the siding panels is surmounted by a longitudinal clamping region having an S-shaped recurved cross-section and a longitudinal nailing strip. The lowermost declination of the siding panels terminates at its lower extremity with an upwardly curving longitudinal edge, the upwardly curving edge of the lowermost declination being receivable in the S-shaped recurved clamping region of a vertically adjacent siding panel. A retaining clip of the invention is attached to at least one end of each declination portion of the siding panels in an orientation which permits the insertion, during use, of the corresponding declination portion of a horizontally adjacent siding panel between the flexible arm portion of the clip and the building-side or rear face of the panel to which the retaining clip is attached.

In an alternative embodiment, a retaining clip is attached to each end of each declination portion of the siding panel, the clips being vertically staggered from one another on the declination portions of the panel to prevent interference with one another when the siding is mounted to a building.

In a third embodiment, the invention provides a method of siding a building with the modified siding panels of the invention. The method comprises the steps of (a) attaching a first panel to the wall of the building; (b) laterally inserting the end of a second panel declination portion between the retaining clips and the building-side face of the corresponding declination portion of the attached first panel; (c) sliding the second panel horizontally until movement of the second panel is retarded by the detent on a retaining clip of the attached first panel; and (d) attaching the second panel to the wall of the building.

The retaining clips of the present invention, and modified siding panels having the clips attached, provide for a tight interlock of adjacent siding panels mounted to a building wall providing improved protection of the underlying wall structure against wind, rain and insect infestation damage.

DETAILED DESCRIPTION

Figure 6:
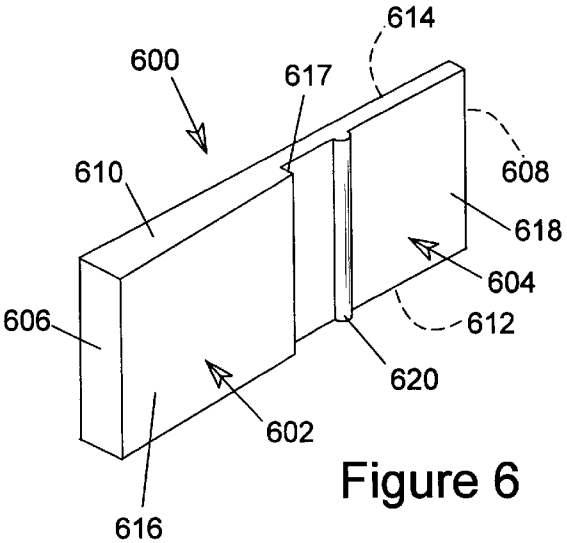
FIG. 6 shows a pictorial view of a first embodiment of siding clips of the invention.

Various embodiments of a siding retaining clip in accordance with the present invention are shown in perspective view in FIGS. 6–10. In FIG. 6, a flat embodiment 600 of a retaining clip of the present invention is shown. The clip 600 comprises a thicker main body portion 602 and a thinner flexible arm portion 604 extending therefrom. The clip has first 606 and second 608 ends, first 610 and second 612 sides, an upper face 614, and first 616 and second 618 lower face regions. The first lower face region 616 of the clip is off-set from the second lower face region 618 in a direction away from the upper face 614 of the clip forming a ledge 617 separating the main body portion 602 of the clip 600 from the depending arm portion 604. A detent 620 protrudes from and extends across the second lower face region 618 from first side 610 to second side 612 and is spaced apart from the ledge 617.

The clip may be fabricated of any flexible and resilient material such as metal or plastic, with thermoplastic materials being preferred. A particularly preferred material is poly(vinyl chloride), "PVC", of the same composition as that employed in the manufacture of vinyl siding panels. The clips may be fabricated of two or more parts or, preferably, are formed as a unitary body by injection molding, stamping, or other methods well known in the thermoplastic arts for forming plastic articles. The dimensions of the clip are not critical, but typically range between about 2 and 3.5 inches (5.1 and 8.9 cm) in length and between about one and two inches (2.54 and 5.1 cm) in width. The clip at its thinnest, near second end 604, preferably ranges between about 0.025 and 0.075 inches (0.06 and 0.19 cm).

In one embodiment, upper face 614 of the retaining clip and lower face region 616 are angled slightly towards one another. This can be seen in FIG. 9 which is a side view presentation of the clip of FIG. 6. The dotted lines represent the extensions of the upper face 614 and first lower surface 616. The dihedral angle between the upper face 614 and the first lower face region 616 of the clip, represented by angle ABC in FIG. 9 preferably ranges between about 2° and about 5°. As a consequence of this preferred range of angles, the greatest thickness of the clip, near end 606, ranges between (tan 2°)L and (tan 5°)L, where L is the length of the clip. For the above-recited lengths of a typical clip, the greatest thickness of the clip would range between about 0.08 and 0.3 inches (0.20 and 0.76 cm). This angling of faces 614 and 616 toward one another ensures that when lower face 616 of the retaining clip is attached to a siding panel, the distal end 608 of the flexible arm 604 touches, or is very near, the surface of the siding panel to which the clip is attached. Thus, when an adjacent siding panel is inserted under this flexible arm of the retaining clip (as described below), the flexible arm of the clip is slightly distorted and the resulting restoring force firmly holds the inserted siding panel in place.

Whether the flexible arm touches the surface of the siding panel (e.g. panel 1100), or is near the siding panel, in either case, flexible arm 604 inherently defines a space between the inner surface of lower facing region 618 and the inner face of the siding panel declination to which the clip is attached. Such space, along with any distortion of the arm when an adjacent siding panel is inserted under the flexible arm, defines the space which receives the end of the adjoining siding panel between the siding panel and clip.

Figure 7:
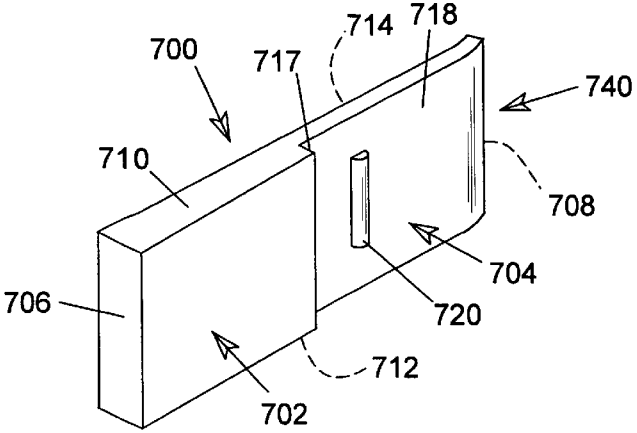
FIG. 7 shows a pictorial view of a second embodiment of siding clips of the invention.

FIG. 7 depicts a preferred alternative embodiment 700 of the clip of the present invention which has a slight outward curve 740 near the second end 708 of the clip. By "outward curve" is meant that the depending flexible arm portion 704 of the clip 700 is curved so that second lower face 718 is curved in a convex manner and the upper face 714 is curved in a concave manner in the region of the clip 700 near its end 708. The clip 700 has otherwise essentially the same elements and construction as the flat clip depicted in FIG. 6 described immediately above. The use of the curved-end clip embodiment shown in FIG. 7, and its advantages, are discussed further below.

Figure 8:
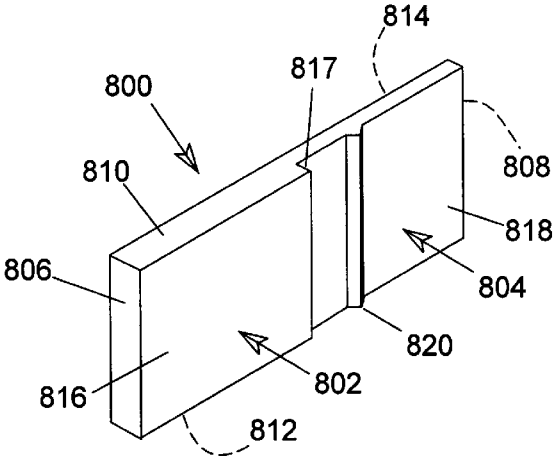
FIG. 8 shows a pictorial view of a third embodiment of siding clips of the invention.

An alternative embodiment of the retaining clip is shown as 800 in FIG. 8. In this embodiment, planes of the faces 814, 816, and 818 of the retaining clip are substantially parallel. In this embodiment of the clip, it is preferred that the offset between face 816 of the main body portion of the clip and face 818 of the flexible arm portion of the clip is roughly equal to the thickness of commercial siding panels, i.e. roughly equal to about 0.025 inches to about 0.05 inches (0.64 mm to 1.3 mm).

In the flat and curved clip embodiments of the retaining clip shown in FIGS. 6 and 7, the detent feature 620 or 720 is shown as a half-round which extends either entirely (FIG. 6) or partially (FIG. 7) across the second lower face 618 or 718 of the flexible arm of the clip from the first side 610 (710) to the second side 612 (712). As shown in FIG. 8, and in the side view of FIG. 10, the protruding detent 820 may also take a triangular cross sectional shape.

These detents are spaced apart from the ledge (e.g. 617 in FIG. 6) separating the main body portion and the depending arm portion of the retention clips by a distance corresponding to the amount of expansion anticipated in the siding, once installed, typically by about ⅜ inches (0.94 cm). The detents are spaced apart from the ledges in a direction toward the second end of the clip. This feature is made clear by reference to FIG. 6 in which detent 620 is spaced apart from ledge 617 in a direction toward second end 608 of clip 600. The purpose and function of the detent feature of the retention clips is discussed further below.

In its use in combination with siding panels, the first lower face region 616 (as in FIG. 6) on the main body portion 602 of the clip 600 is attached to the rear face of the declination of a siding panel. It is important that the area on the clip devoted to this function is sufficient for firm bonding of the clip to the siding panel. It is likewise important that the clip arm 604 portion of the clip be of sufficient length to have the needed flexibility. For this reason, the main body portion 602 and the flexible arm portion 604 of the clip are of preferably of roughly the same length and width dimensions. Stated otherwise, the first lower face region 616 and second lower face region 618 of the clip preferably occupy roughly equal portions of the lower face of the clip.

In its preferred use with PVC or "vinyl" siding, the clip is preferably also fabricated of PVC. As a result, the clip has the requisite flexibility, resilience, and resistance to weathering. Being also made of PVC, the clip can be quickly and rigidly bonded to the siding panel by means of a PVC cement of the type manufactured by Hercules Chemical Co, Inc., 111 South Street Passaic, N.J. 07055-7398 or by means of a strong weather-resistant double-sided peel-and-stick type tape such as Scotch® brand Y4945VHB tape available from 3M Company, St. Paul, Minn. 55144-1000. Alternatively, such techniques as thermal or ultrasonic bonding well known in the plastic fabrication arts may be used. The attachment of the clips to the rear face of the declinations of a siding panel can be done either during manufacture, or in the field as the siding is applied to a building. In a preferred embodiment, the clips are attached to the siding panels during manufacture. However, it is frequently necessary in the field to cut siding panels during application to a building for purposes of fit. As a result, the end of a cut panel section might lack a retaining clip, resulting in unnecessary scrap. The field installation of a clip of the invention to such a cut segment minimizes the amount of scrap pieces, with the attendant cost savings.

Figure 9:
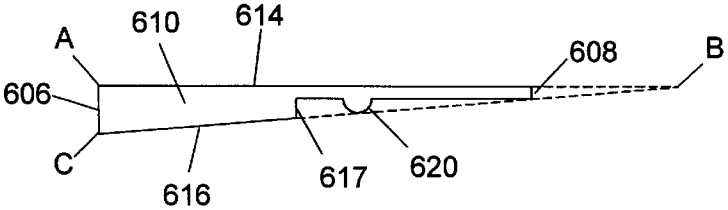
FIG. 9 shows a side view of a tapered clip of the invention as in FIG. 6.
Figure 10:
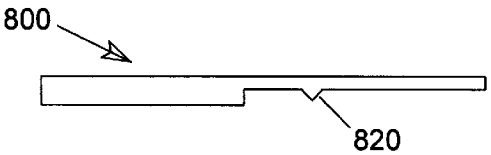
FIG. 10 show a side view of the clip of FIG. 8.
Figure 11:
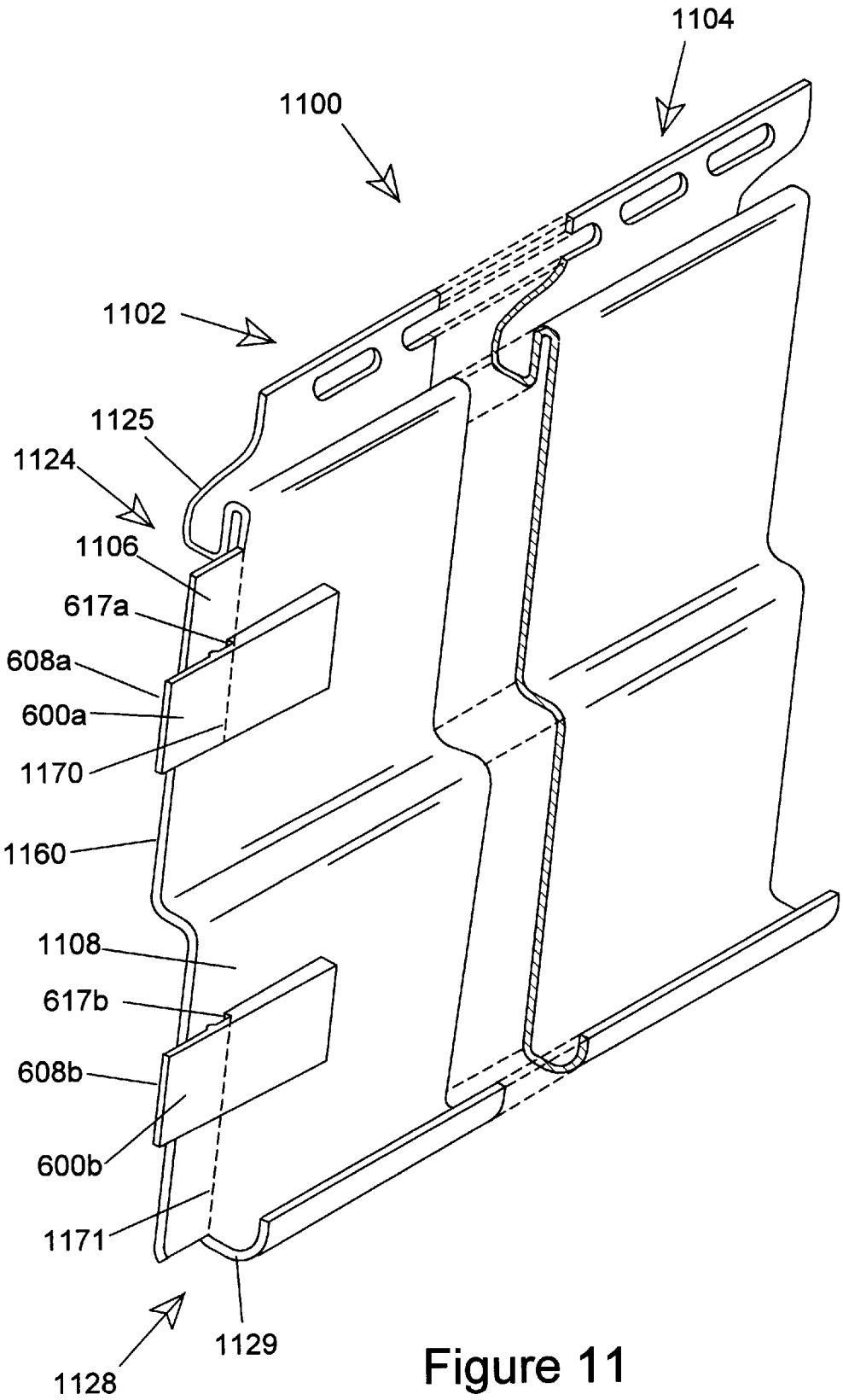
FIG. 11 shows a pictorial view of the back of a siding panel of the invention employing end clips of the invention.

FIG. 11 depicts in rear perspective view an improved two-wide siding panel assembly 1100 according to another embodiment of the present invention. The Figure depicts the left-hand end portion 1102 and right-hand end portion 1104 of a panel with the center portion of the long siding panel removed for purposes of illustration. Declination retention clips 600*a* and 600*b* of the flat angled type depicted in FIGS. 6 and 9 are shown attached to the rear faces of upper 1106 and lower 1108 declinations of the panel, roughly centered vertically on each declination. It is understood that, in a three-wide siding panel, declination retention clips would be attached to, and roughly centered vertically on each of the three declinations at one or both ends of the panel. In four-wide and wider siding panels, declination retention clips would be similarly located at one or both ends of the panel, each roughly centered vertically on each of the declinations.

In FIG. 11, the declination retention clips 600*a* and 600*b* illustrated are of the angled and "flat clip" embodiment illustrated in FIGS. 6 and 9, having the features discussed above. These angled and flat clips are preferably attached to the siding panel 1100 in such a manner that the ledge on the clip separating the main body portion of the clip from the depending arm portion is aligned with the nearest cut-out on the siding panel. Thus in FIG. 11, retention clip 600*a* is attached to the siding panel so that ledge 617*a* is aligned with edge 1125 of cut-out 1124 as indicated by dashed line 1170. Similarly, the lower retention clip 600*b* is attached to the siding panel so that its ledge 617*b* is aligned with inner edge 1129 of cut-out 1128 as indicated by dashed line 1171. This alignment feature permits the proper positioning of retention clips which are attached to siding panels in the field by siding installers. Alignment of the retention clip ledges and cut-outs ensures, in turn, proper alignment of the detents on each retention clip.

When retention clips of this flat design are employed in fabricating the improved siding of the invention, it is preferred that the clips be of a length such that, when aligned as discussed above, the second ends 608*a* and 608*b* of the respective clips 600*a* and 600*b* extend slightly beyond and overhang the edge 1160 of the siding panel. This overhang of the retention clips provides a starting point for insertion of a laterally adjacent panel between the retention clip and the declination panel bearing the clip as discussed below.

Figure 12:
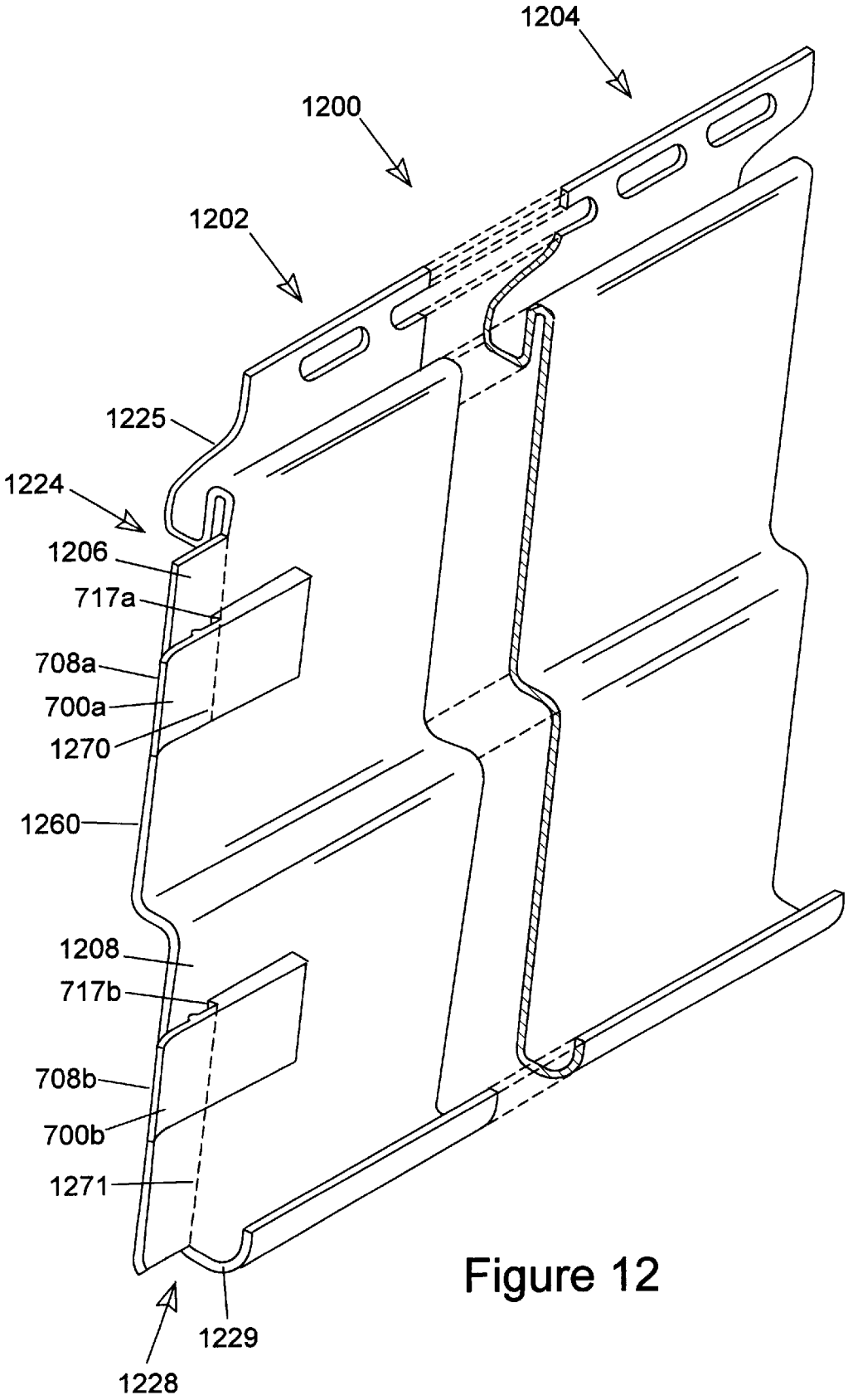
FIG. 12 shows a pictorial view of the back of a siding panel of the invention employing a second embodiment of end clips of the invention.

FIG. 12 depicts in rear perspective view an improved two-wide siding panel assembly 1200 according to another embodiment of the present invention. The figure corresponds in every regard to the panel and clips of FIG. 11, with the exception that the curved-end clips of the embodiment shown in FIG. 7 have been attached to one end of each of the rear faces of the declination portions of the siding panel. FIG. 12 depicts the left-hand end portion 1202 and right-hand end portion 1204 of a panel with the center portion of the long siding panel removed for purposes of illustration. Curved-end declination retention clips 700*a* and 700*b* are attached, respectively, to the rear faces of upper 1206 and lower 1208 declinations of the panel, roughly centered vertically on each declination. As discussed above, the ledges of the retention clips are aligned with the nearest cut-out. Thus in FIG. 12, retention clip 700*a* is attached to the siding panel so that ledge 717*a* is aligned with edge 1225 of cut-out 1224 as indicated by dashed line 1270. Similarly, the lower retention clip 700*b* is attached to the siding panel so that its ledge 717*b* is aligned with inner edge 1229 of cut-out 1228 as indicated by dashed line 1271. However, unlike the panel embodiment with the angled flat retention clip design, the clips of the curved-end design are of a length such that when attached and aligned, their outer ends are flush with the end of the siding panel. Thus in FIG. 12, when aligned as discussed above, the second ends 708*a* and 708*b* of the respective clips 700*a* and 700*b* are flush with the edge 1260 of the siding panel. This flush-ended feature permits easier packaging of multiple siding panels than is the case in the flat clip design siding where the clips slightly overhang the ends of the siding panels. With the curved-ended retention clip embodiment, the recurve on the end of the clip provides the starting point for insertion of an adjacent panel and, as a result, there is no need for the ends of the clips to extend beyond the edge of the siding panel, as with the angled flat clips.

Figure 13:
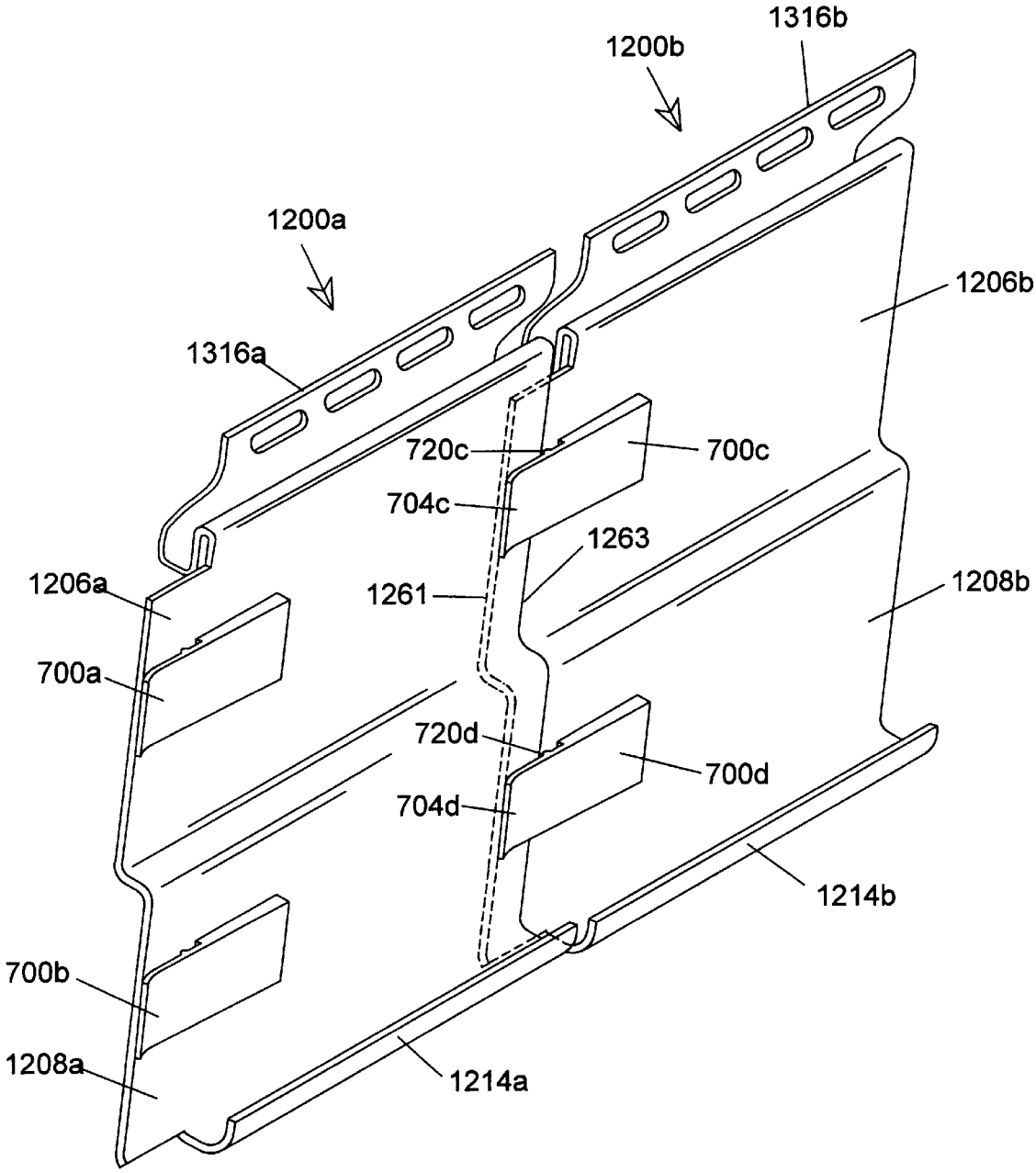
FIG. 13 shows a pictorial view of portions of two panels of the type depicted in FIG. 12 clipped together in a side-by-side arrangement using curve-ended retaining clips.

FIG. 13 shows two panel assemblies 1200*a* and 1200*b* of the type depicted in FIG. 12 clipped together in a side-by-side arrangement using the curve-ended retaining clips depicted in FIG. 7. The two panels are shown with their lengths somewhat abbreviated for purposes of illustration. As viewed from the rear, the right hand end of siding panel 1200*a* has been inserted behind the left hand end of siding panel 1200*b*. The upper declination portion 1206*a* of left hand panel 1200*a* has been inserted between flexible arm 704*c* of retaining clip 700*c* and the rear face of declination portion 1206*b* of panel 1200*b* so that edge 1263 abuts detent 720*c* on clip 700*c*. Similarly, the lower declination portion 1208*a* of left hand panel 1200*a* has been inserted between flexible arm 704*d* of retaining clip 700*d* and the rear face of declination portion 1208*b* of panel 1200*b* so that edge 1263 abuts detent 720*d* on clip 700*d*. The cut-outs at the tops and bottoms of each panel interlock in the manner described previously.

Figure 1:
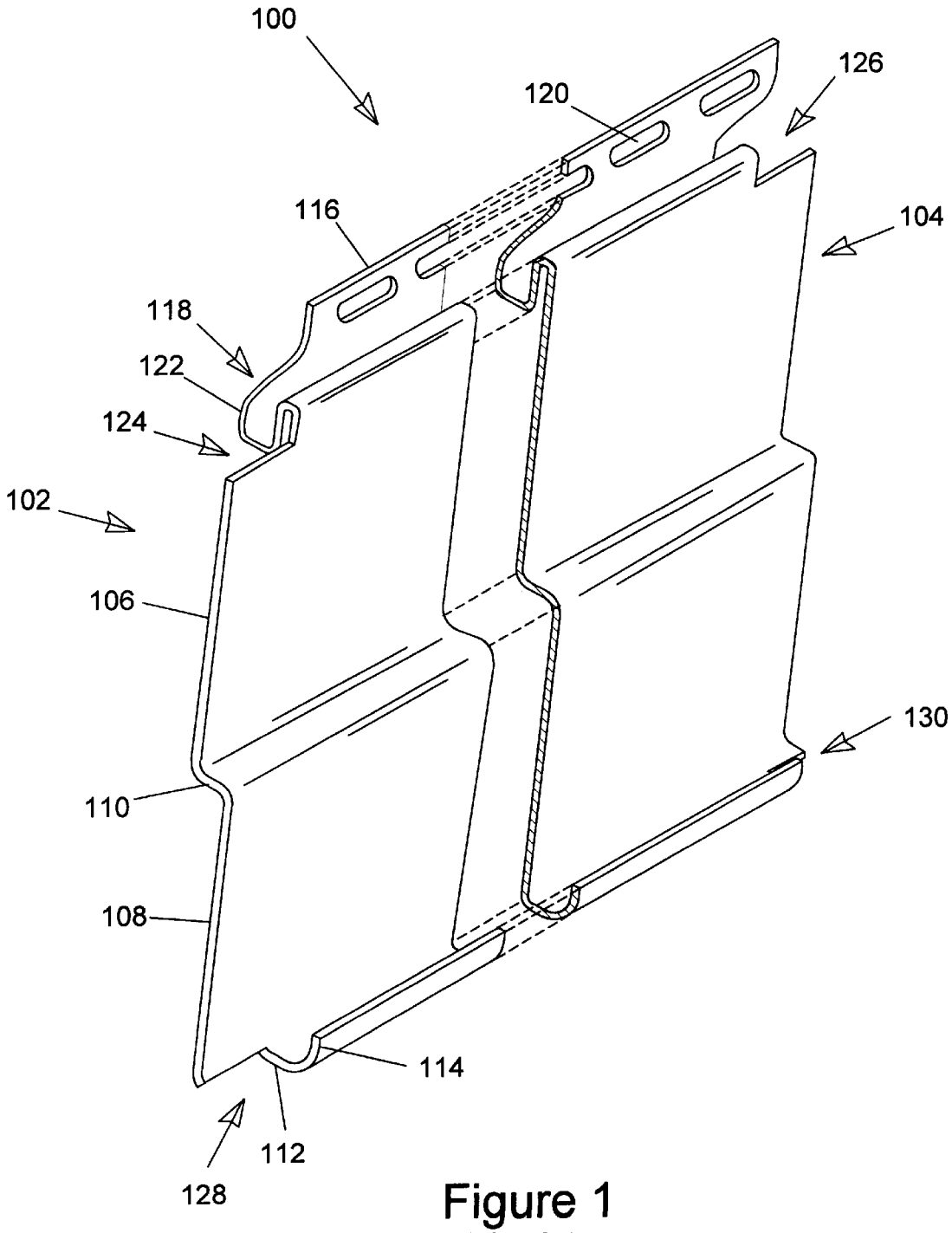
Figure 1 Prior Art
FIG. 1 shows a pictorial view of a prior art siding panel.
Figure 2:
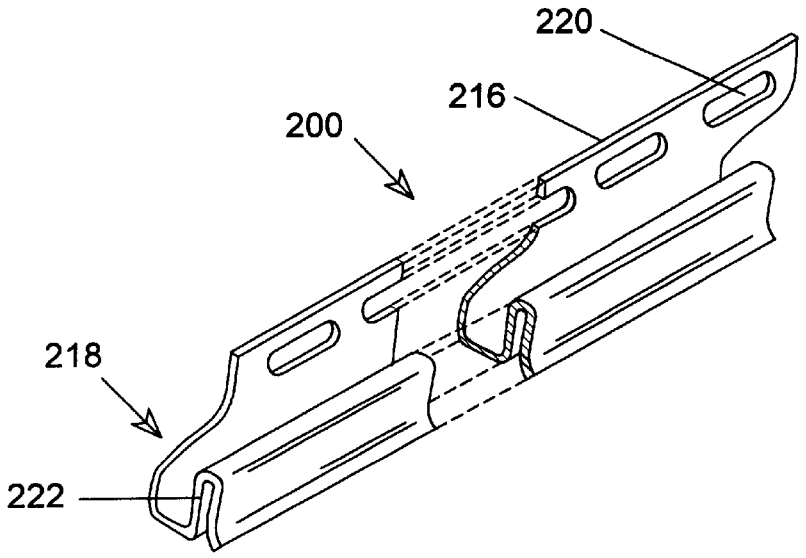
Figure 2 Prior Art
FIG. 2 shows a pictorial view of a prior art starter strip.
Figure 3:
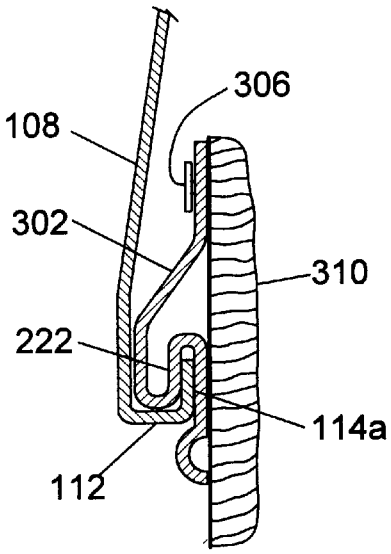
Figure 3 Prior Art
FIG. 3 shows a cross-section of a prior art starter strip of FIG. 2 mounted to a wall of a building.
Figure 4:
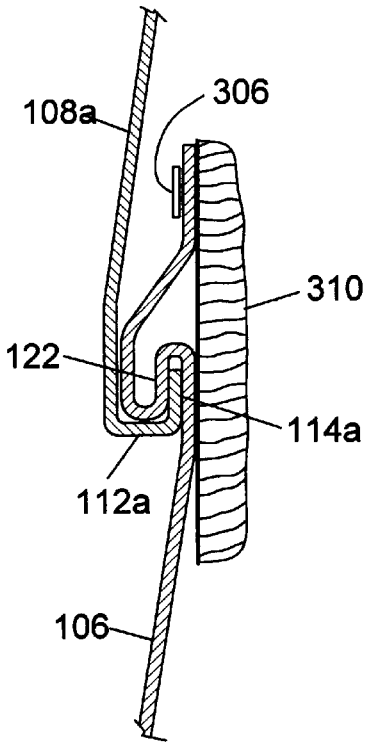
Figure 4 Prior Art
FIG. 4 shows a cross-section of a prior art joint between vertically adjacent siding panels, fastened to a building.
Figure 5:
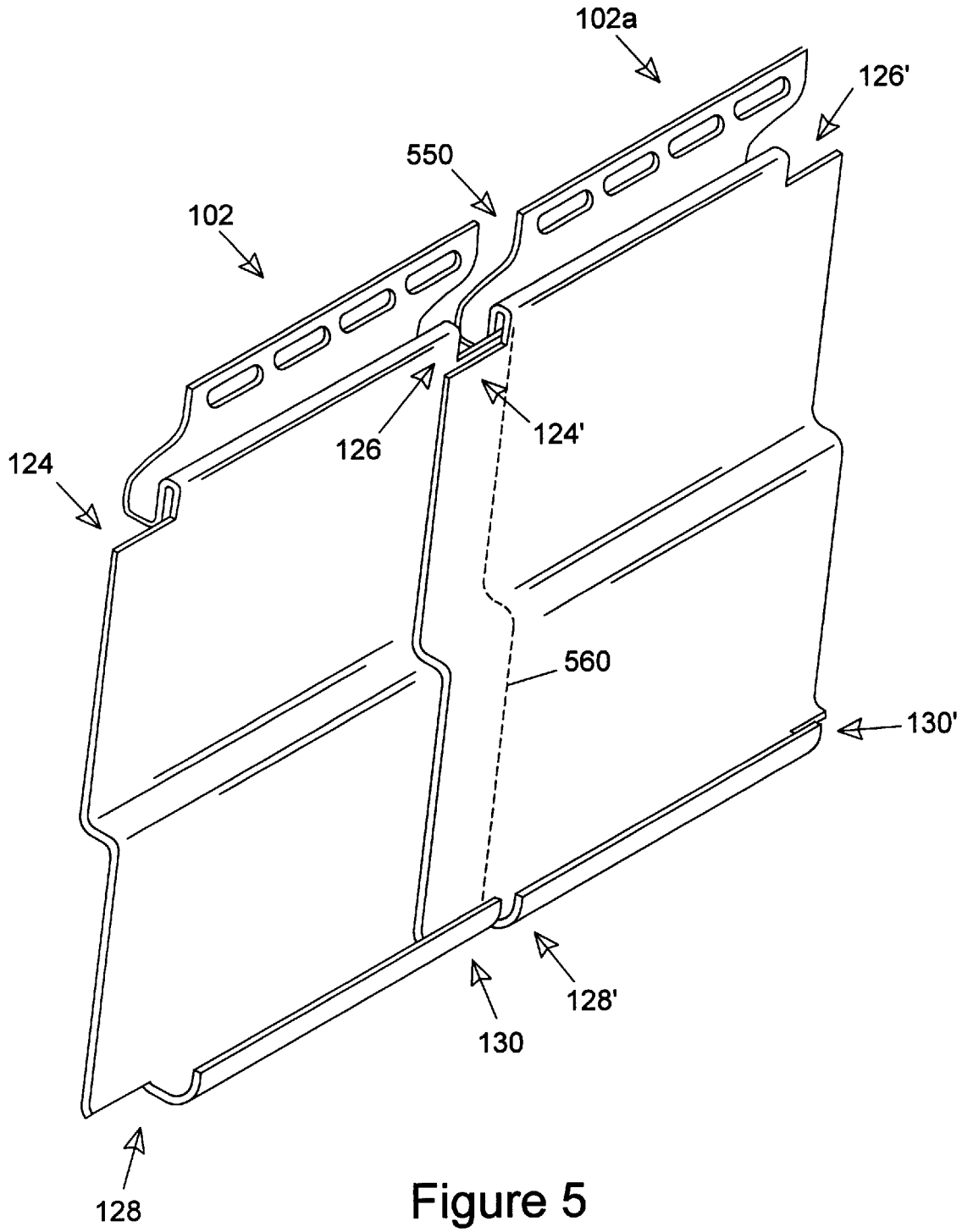
Figure 5 Prior Art
FIG. 5 shows a pictorial view of ends of horizontally adjacent prior art siding panels, including conventional end-to-end engagement of the siding panels.

Thus, siding panels 1200*a* and 1200*b* have been laterally interlocked at four, rather than two points along the ends of the panels in contradistinction to the prior art arrangement shown in FIG. 5. The resulting interlock arrangement ensures improved resistance to wind, moisture, and insect damage described above.

Figure 14:
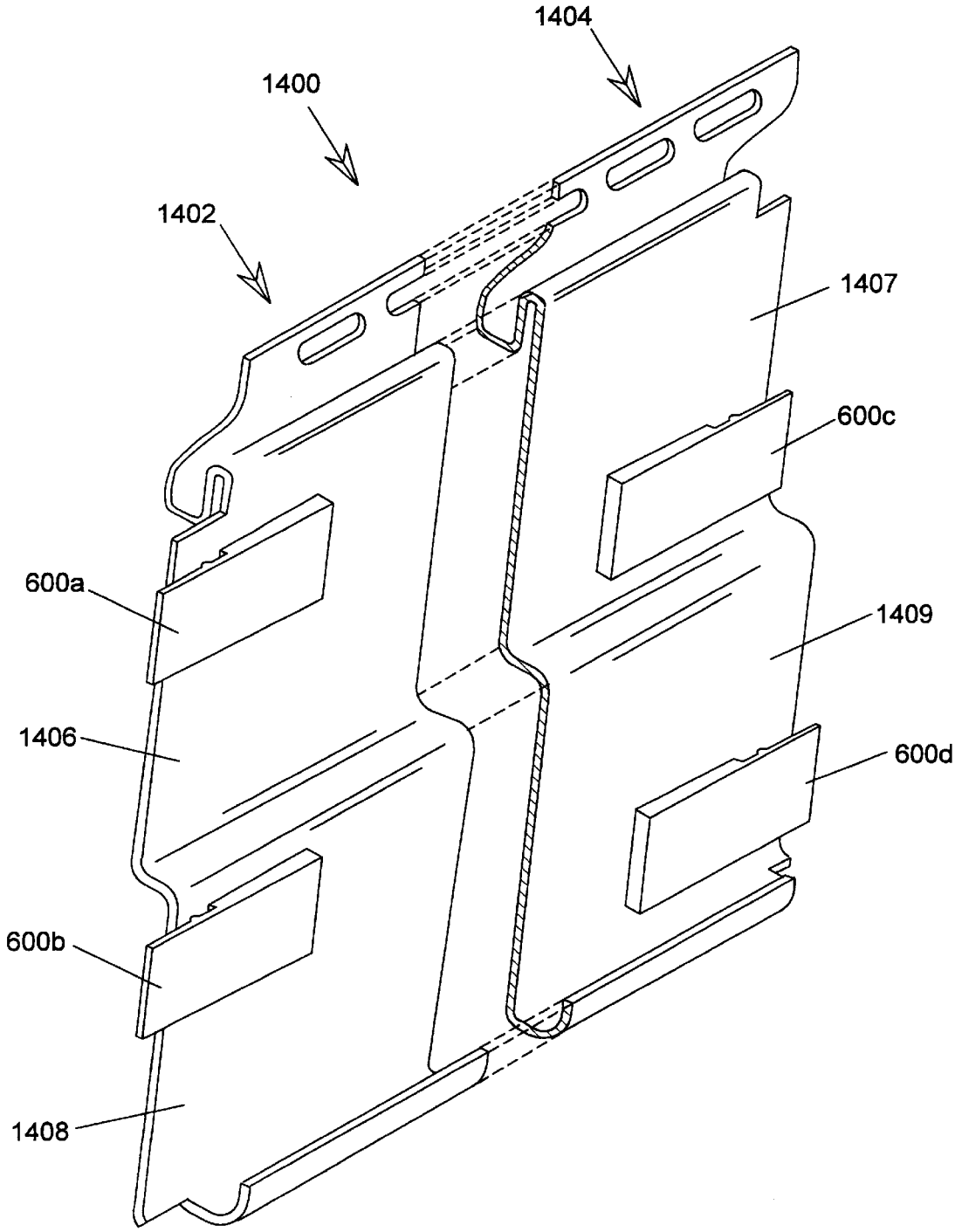
FIG. 14 shows a pictorial view of end portions of a siding panel having retaining clips are attached to each end portion of each declination portion of the siding panel.
Figure 15:
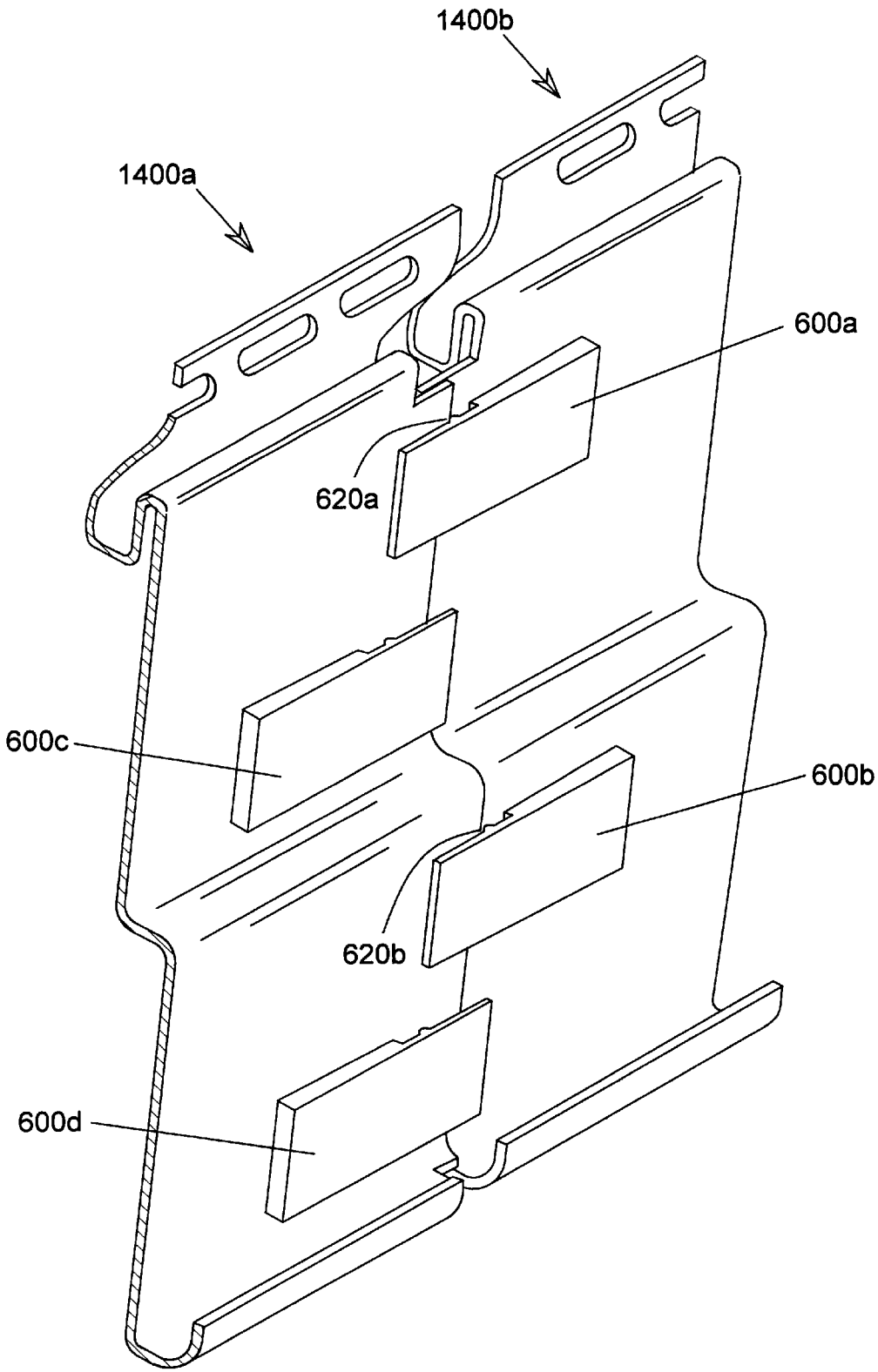
FIG. 15 shows two siding panels clipped together in side-by-side arrangement.

FIG. 14 shows a particularly preferred embodiment of the present invention where retaining clips are attached at each end of each declination portion of the siding panel assembly. In FIG. 14, a single siding panel 1400 is shown with the center portion of the panel removed for purposes of illustration. The left hand end 1402 of the siding panel is shown with flat retaining clips 600*a*, and 600*b* of the types depicted in FIG. 6 attached, respectively, to the lefthand end of the upper declination portion 1406 and lower declination portion 1408 of the panel. In a similar manner retaining clips 600*c* and 600*d* are shown attached, respectively, to the upper declination portion 1407 and lower declination portion 1409 of the right hand end of panel 1400. The retaining clips attached to each declination portion of the siding panel are staggered vertically with respect to one another, so that when two such panels are clipped together in a side-by-side arrangement as shown in FIG. 15, there is no interference. Thus, retaining clip 600*a* is shown attached to declination portion 1406 of the panel slightly above retaining clip 600*c* at the other end of the panel. Similarly, clip 600*b* is shown attached to lower declination portion 1408 slightly above clip 600*d*.

In FIG. 14, the retaining clips illustrated are of the angled flat embodiment of FIG. 6, and are shown as extending slightly beyond the respective ends of the panel in the manner discussed above. It is to be understood, however, that retaining clips of any embodiment of the present invention may be used in the panel embodiment in which the clips are provided at both ends of each declination portion.

FIG. 15 illustrates two panel assemblies 1400*a* and 1400*b* of the type depicted in FIG. 14 clipped together in a side-by-side manner. The two panels are shown as abbreviated in length for purposes of illustration. The right-hand end of panel 1400*a* is shown inserted under the clips 600*a* and 600*b* in the same manner as described above, and the edge 1563 abuts the detents 620*a* and 620. Clips 600*c* and 600*d* are unused.

The retention clips and improved siding having such retention clips attached thus present the following advantages over known vinyl siding: first, siding panels of the present invention install without unsightly gaps between laterally adjacent panels in the area of the panel declinations. Second, the siding panels of the present invention are less susceptible to wind damage. Third, the siding panels of the present invention are less susceptible to moisture or insect invasion behind the mounted panels. Finally, panels of greater width (three-wide, four-wide) can be fabricated and mounted to building walls with less problems associated with the attendant increase in the vertical spacing between nailings.

While there have been shown and described the preferred embodiments of the retention clips and improved siding of the present invention, it will be readily apparent to one of skill in the relevant art that various modifications may be made in these embodiments without departing from the scope of the present invention as it is described in the appended claims.

I claim:

1. A building siding panel assembly of a type which simulates wooden clapboard, said siding panel assembly comprising:

(a) a building siding panel having a top and a bottom, a first end region and a second end region, two or more longitudinally extending, and outwardly and downwardly depending, declination portions, each said declination portion having a top and a bottom, the uppermost declination portion being surmounted by a longitudinal clamping region, the lowermost declination portion terminating at a lower extremity thereof in an upwardly curving longitudinally extending edge, the upwardly curving edge of the lowermost declination portion being receivable in the longitudinally extending clamping region of a vertically adjacent siding panel when the panels are mounted to a building wall; and (b) a retaining clip attached to an inner face of said siding panel at one said end region of a respective said declination portion, and defining a space at said one end region between the inner face of said siding panel and a flexible arm portion of said retaining clip, said retaining clip being oriented such that the space is disposed between an end edge of said building siding panel assembly and a main body portion of said retaining clip, whereby said retaining clip is positioned to receive in the space between said clip and the inner face of said declination portion, an end region of a corresponding declination portion of a laterally adjacent siding panel.

2. A building siding panel assembly as in claim 1 having a said retaining clip attached to each of said declination portions at both of said first and second end regions of said panel.

3. A building siding panel assembly as in claim 1 wherein said retaining clip comprises a relatively thicker main body portion, and a relatively thinner flexible arm portion extending from the main body portion.

4. A building siding panel assembly as in claim 3 wherein said retaining clip comprises first and second ends, first and second sides, a lower face, and an upper face, and wherein the lower face of the flexible arm portion of the retaining clip is further provided with an outwardly depending detent.

5. A building siding panel assembly as in claim 4 wherein the lower face of the retaining clip is divided into a first lower face portion, offset from a second lower face portion by a ledge which divides the retaining clip between the main body portion and the flexible arm portion, and wherein the detent of the retaining clip is spaced from the ledge by a distance sufficient to allow for anticipated thermal expansion of said siding panel under expected use conditions.

6. A building siding panel assembly as in claim 5 wherein the detent of the attached retaining clip is spaced from the ledge by a distance of about one-quarter inch (0.64 cm) to about one-half inch (1.27 cm).

7. A building siding panel assembly as in claim 4 wherein the detent of the retaining clip retards the leading edge of an adjacent siding panel inserted between the clip and a siding panel to which the clamp is attached, but permits the leading edge of the inserted panel to move past the detent in response to thermal expansion of the siding panels when the siding panels are mounted to a building wall.

8. A building siding panel assembly as in claim 7 wherein the cross-sectional shape of the detent is selected from shapes defined by the arc of a circle or an ellipse, and a triangle.

9. A building siding panel assembly as in claim 3 wherein said retaining clip comprises first and second ends, first and second sides, a lower face, and an upper face, and wherein the lower faces of the main body portions of ones of said retaining clips attached to and substantially vertically centered on one end of each declination portion of the panel, at a respective end of the panel.

10. A building siding panel assembly as in claim 3 wherein said retaining clip comprises first and second ends, and first and second sides, a lower face and an upper face, and wherein the lower face of the flexible arm portion of the retaining clip is substantially flat, the retaining clip being attached to the siding panel such that the second end of the clip, defining the end of the flexible arm portion of the clip distal from the main body portion of the clip, extends past an end edge of the siding panel to provide a starting point for insertion of a declination of a horizontally adjacent siding panel between the flexible arm portion of the clip and the siding panel to which the clip is attached.

11. A building siding panel assembly as in claim 3 wherein said retaining clip comprises a lower face and an upper face, and wherein the flexible arm portion of the retaining clip is curved at a distal end portion thereof such that in the region of the curve, the lower face of the flexible arm portion of the clip defines a convex curvature, the curve of the flexible arm portion of the clip facilitating inserting a declination portion of a horizontally adjacent siding panel between the flexible arm portion of the clip and the siding panel to which the clip is attached.

12. A building siding panel assembly as in claim 1 wherein a said retaining clip is attached to each end of each declination portion of the panel, the positions of the retaining clips at the respective ends being vertically staggered with respect to one another.

13. A building siding panel assembly of a type which simulates wooden clapboard, said siding panel assembly comprising:

(a) a building siding panel having a top and a bottom, a first end region and a second end region, two or more longitudinally extending, outwardly and downwardly depending, declination portions, each said declination portion having a top and a bottom, the uppermost declination portion being surmounted by a longitudinal clamping region, the lowermost declination portion terminating at a lower extremity thereof in an upwardly curving longitudinally extending edge portion, the upwardly curving edge of the lowermost declination portion being receivable in the longitudinally extending clamping region of a vertically adjacent siding panel when the panels are mounted to a building wall; and (b) a retaining clip attached to an inner face of said siding panel at one said end region of a respective said declination portion, said declination portion retaining clip comprising a main body portion, and an arm portion depending from the main body portion, the arm portion defining a space at said one end region between the inner face of the respective said declination portion and a facing surface of said arm portion of said retaining clip, the combination of said siding panel and said retaining clip thereby being configured to receive the corresponding declination portion of a laterally adjacent siding panel in the space between said clip and the inner face of said declination portion.

14. A building siding panel assembly as in claim 13, including a said declination portion retaining clip attached to each of said declination portions of said siding panel at both of said first and second end regions of said siding panel.

15. A building siding panel assembly as in claim 13, said retaining clip comprising a lower face disposed toward said siding panel, the lower face including an outwardly depending detent on the lower face extending from the main body portion to the flexible arm portion of the retaining clip.

16. A building siding panel assembly as in claim 15 wherein the lower face of the retaining clip is divided into a first lower face portion, offset from a second lower face portion by a ledge which divides the retaining clip between the main body portion and the flexible arm portion, and wherein the detent of the retaining clip is spaced from the ledge by a distance sufficient to allow for anticipated thermal expansion of said siding panel under expected use conditions.

17. A building siding panel assembly as in claim 16 wherein the detent of the attached retaining clip is spaced from the ledge by a distance of about 0.25 inch (0.64 cm) to about 0.5 inch (1.27 cm).

18. A building siding panel assembly as in claim 15 wherein the detent of the retaining clip retards the leading edge of an adjacent siding panel inserted between the clip and a siding panel to which the clamp is attached, but permits the leading edge of the inserted panel to move past the detent in response to thermal expansion of the siding panels when the siding panels are mounted to a building wall.

19. A building siding panel assembly as in claim 13 wherein said retaining clip comprises a lower face disposed toward said siding panel, and wherein the lower face of the main body portions of ones of said retaining clips are attached to and substantially vertically centered on each declination portion of the panel, at a respective end of the panel.

20. A building siding panel assembly as in claim 13 wherein a said retaining clip is attached to each end of each declination portion of the panel, the positions of the retaining clips at the respective ends being vertically staggered with respect to one another.

21. A building siding panel assembly as in claim 13 wherein said retaining clip comprises first and second ends, and first and second sides, a lower face and an upper face, and wherein the lower face of the flexible arm portion of the retaining clip is substantially flat, the retaining clip being attached to the siding panel such that the second end of the clip, defining the end of the flexible arm portion of the clip distal from the main body portion of the clip, extends past an end edge of the siding panel to provide a starting point for insertion of a declination of a horizontally adjacent siding panel between the flexible arm portion of the clip and the siding panel to which the clip is attached.

22. A building siding panel assembly as in claim 13 wherein said retaining clip comprises a lower face and an upper face, and wherein the flexible arm portion of the retaining clip is curved at a distal end thereof such that in the region of the curve, the lower face of the flexible arm portion of the clip defines a convex curvature, the curve of the flexible arm portion of the clip facilitating inserting a declination portion of a horizontally adjacent siding panel between the flexible arm portion of the clip and the siding panel to which the clip is attached.

* * * * *